United States Patent [19]

Abernethy

[11] 4,261,633

[45] Apr. 14, 1981

[54] WIRING MODULE FOR TELEPHONE JACK

[75] Inventor: Lynn W. Abernethy, Advance, N.C.

[73] Assignee: AMP Incorporated, Harrisburg, Pa.

[21] Appl. No.: 70,221

[22] Filed: Aug. 27, 1979

[51] Int. Cl.[3] ..... H01R 4/10

[52] U.S. Cl. ..... 339/97 P; 339/123; 339/126 R; 339/176 M

[58] Field of Search ..... 339/97 R, 98 R, 99 R, 339/122 R, 123, 128, 176 M, 125, 126, 176 MP, 97 P; 179/1 PC

[56] References Cited

U.S. PATENT DOCUMENTS

| | | | |
|---|---|---|---|
| T958,009 | 5/1977 | Snyder | 339/99 R |
| T961,003 | 8/1977 | Krumreich | 339/176 M |
| 2,356,752 | 8/1944 | Deysher | 339/123 |
| 3,611,264 | 10/1971 | Ellis, Jr. | 339/99 R |
| 3,850,497 | 11/1974 | Krumreich | 339/126 R |
| 3,990,764 | 11/1976 | Krumreich | 339/176 M |
| 4,103,985 | 8/1978 | Krolak et al. | 339/126 R |
| 4,146,292 | 3/1979 | Garrett | 339/176 M |
| 4,168,874 | 9/1979 | Weidler | 339/128 |

FOREIGN PATENT DOCUMENTS

| | | | |
|---|---|---|---|
| 1434003 | 4/1976 | United Kingdom | 339/98 |

*Primary Examiner*—John McQuade
*Attorney, Agent, or Firm*—Gerald K. Kita; Jay L. Seitchik

[57] ABSTRACT

An equivalent universal telephone jack is disclosed including a base module on which wire terminations are made without the need for special tools. A variety of covers are interchangeably assembled to the base module, adapting the same for mounting in a cabinet, for providing a series of tap offs along a telephone wiring system or for retrofitting existing telephone wiring systems with replacement jacks.

9 Claims, 12 Drawing Figures

WIRING MODULE FOR TELEPHONE JACK

FIELD OF THE INVENTION

The present invention relates to an electrical connector for the national telephone wiring system, and to an outlet jack assembled with standard tools to new or existing telephone wiring, with the jacks being adaptable to various configurations.

BACKGROUND OF THE INVENTION

A universal plug and jack configuration for telephone wiring has been selected for a national standard telephone interconnect system. The universal jacks and plugs will also be incorporated into data processing and data transmitting equipment, as well as consumer and business machines, adapting such equipment for interconnection over telephone communication networks.

Existing telephone wiring systems in buildings must be retrofitted with standard jacks, replacing existing telephone jacks which are obsolete. Both new and existing wiring systems will require individually tailored wall mountings for jacks.

There is a need for an equivalent jack, that is, a jack which incorporates the universal profile configuration and electrical characteristics of the universal jack. Further, there is a need for an equivalent jack which can be retrofitted to existing telephone wiring and which can be installed in existing or new telephone wiring with standard tools, with ease of installation and with minimum consumption of wire. Further, there is a need for an equivalent jack having a basic, unchanged wiring module incorporated into various assemblies.

SUMMARY OF THE INVENTION

The present invention resides in a wiring module together with interchangeable covers to custom build various forms of an equivalent universal telephone jack. One type of cover adapts the module for incorporation into electronic equipment that transmits or receives information transmitted over telephone transmission networks. Covers of other types include various styles of outlet jacks which can be assembled to telephone wires routed from point to point, through the interior of a building.

The wiring module according to the invention utilizes free standing electrical terminals which are ideal for terminating small gauge, telephone wires, routed through a building to interconnect telephone outlet jacks. At each jack location, free ends of the telephone wires project outwardly of a wall opening. These wires are terminated in the free standing terminals of the module using a standard tool such a nut driver or binding post tool of the type normally carried by telephone installers. Only small amounts of the wires are consumed when terminated, leaving slack lengths available for subsequent repairs. The wires are terminated merely by insertion along a slot between insulation slicing and wire gripping jaws of the terminals. No stripping of the wires is required.

Wire splicing is readily accomplished without interrupting the terminated wires already installed. This advantage allows a prewired univeral telephone jack to be spliced into the terminals of an installed module merely by inserting the insulated leads of the module into the terminal jaws. Splicing is accomplished without interrupting data transmission which may be occurring over the installed module. A telephone extension cord may be spliced directly into an installed module without disassembly of existing electrical connections or interrupting data transmission occurring during installation of the extension cord.

To complete the assembly, a cover, which incorporates the universal jack opening and a desired type of face plate, is assembled with the module and secured over the wall opening. In retrofitting existing telephone wires with equivalent universal jacks, a variety of cover styles is provided from which one is selected for compatability with the wall opening and face plate style desired.

Existing telephone wiring may have been foreshortened by removal of obsolete jacks or by previous repair work. The foreshortened wires are readily connected to the terminals of the module with very little consumption of wire being necessary. The selection of a suitable cover from a variety of styles will tailor each outlet for the desired appearance and available wall mounting feature.

Alternative covers allow not only different styles of face plates, but also varied uses of the module. For example, one type of cover may be selected to adapt the module for mounting in a panel opening or in an opening of a cabinet, housing electronic apparatus which may have its data transmission lines connected with the module for subsequent connection to telephone transmission networks.

An object of the present invention is to provide an equivalent universal telephone jack in the form of a wiring module capable of terminating telephone wires and capable of slicing telephone wires, together with a cover for assembly with the module to adapt the module for desired purposes.

Another object of the present invention is to provide an equivalent universal telephone jack to replace obsolete telephone hardware, with ease of installation and minimum wire consumption, while tailoring each replacement jack for the desired appearance and available wall mounting feature.

Another object of the present invention is to provide an equivalent universal telephone jack into which prewired universal telephone jacks can be spliced without disturbing electrical connections already in place, and without interrupting data transmission over existing installed jacks.

Another object of the present invention is to provide an equivalent universal telephone jack incorporating a wiring module which may be incorporated into a variety of assemblies, tailoring the module for various purposes.

Other objects and advantages of the present invention will become apparent from the following detailed description taken in conjunction with the drawings.

DRAWINGS

FIG. 3 is an enlarged exploded perspective of the embodiment shown in FIG. 1.

DETAILED DESCRIPTION

Figure 4:
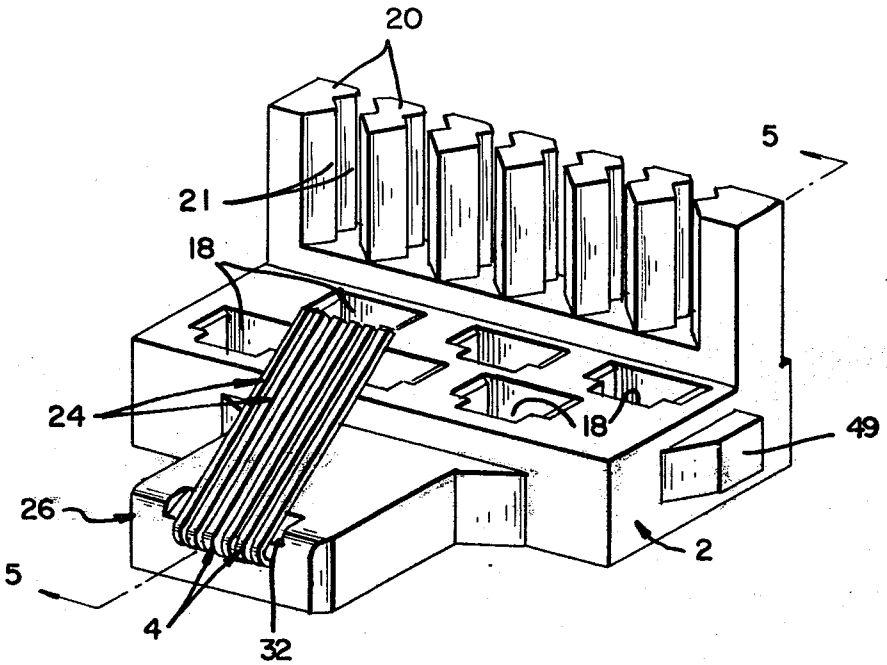
FIG. 4 is an enlarged perspective of a base portion of a wiring module according to the present invention.
Figure 6:
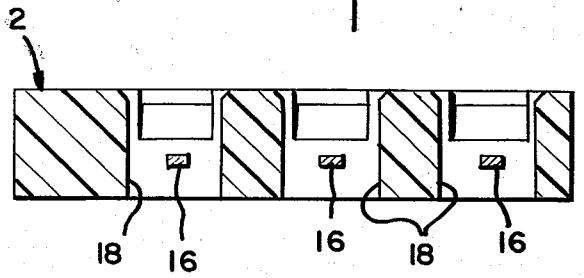
FIG. 6 is a section taken along the line 6—6 of FIG. 5.
Figure 5:
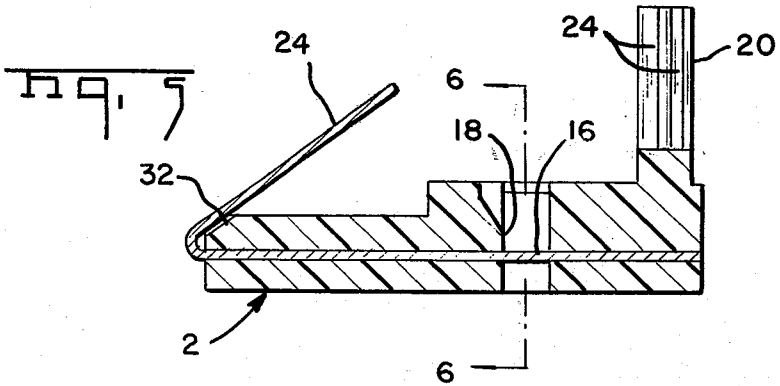
FIG. 5 is a section taken along the ling 5—5 of FIG. 4.
Figure 7:
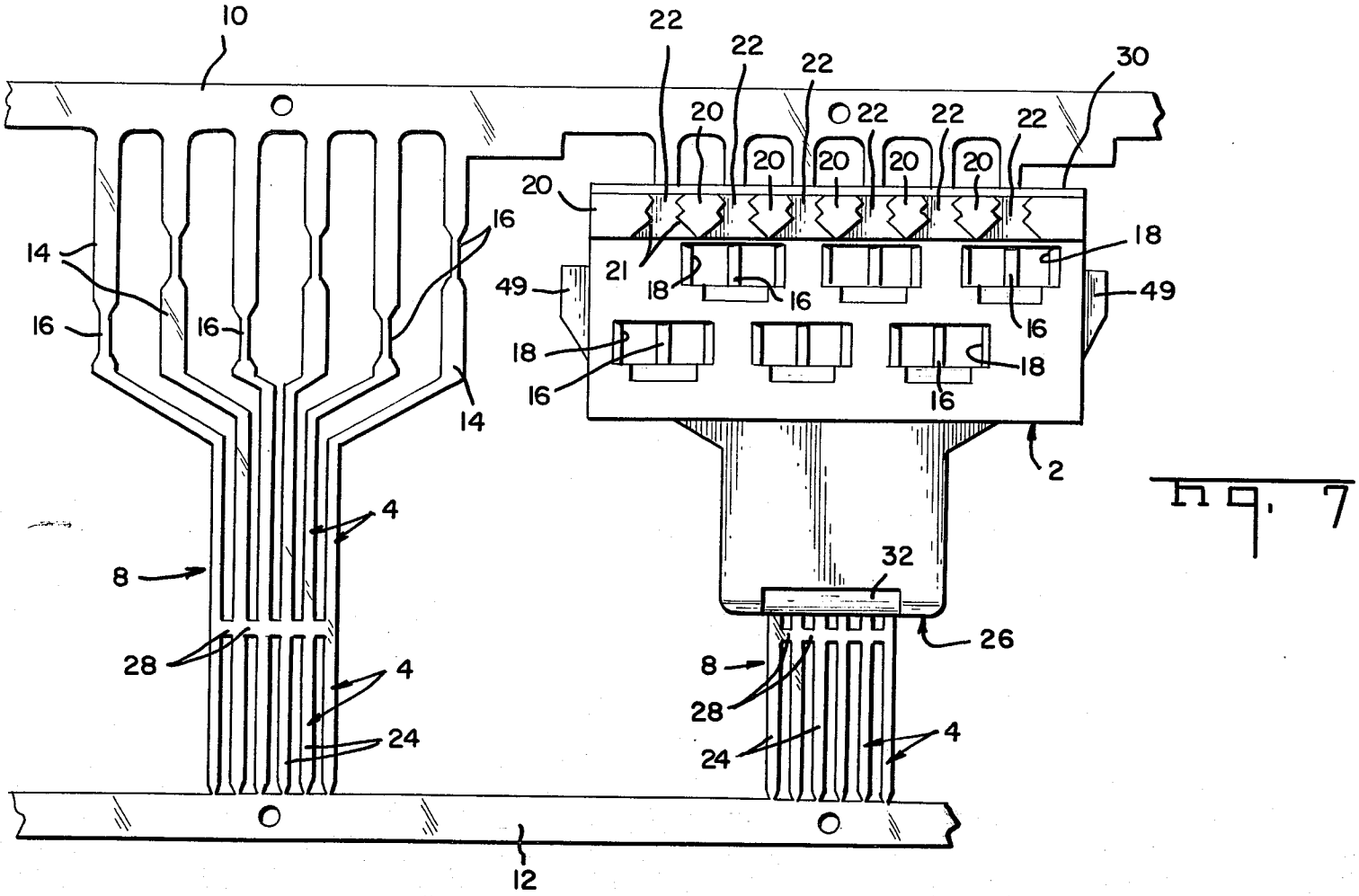
FIG. 7 is an enlarged fragmentary plan of a series of lead frames interconnected by carrier strips, illustrating various stages of manufacture of the module shown in FIG. 4.

With more particular reference to the drawings, FIG. 3 illustrates generally at 1 a wiring module according to the present invention comprising a molded dielectric base 2, a plurality of metal strip circuits 4 and a plurality of free standing electrical terminals 6. FIG. 7 illustrates the circuits 4 in the form of a lead frame 8 initially integral with and between a pair of metal carrier strips 10 and 12. In practice, a series of lead frames 8 together with the carrier strips 10 and 12 are stamped and formed from a single strip of metal. The circuits 4 include relatively widely spaced portions 14 each having a narrow neck portion 16. Adjacent portions 16 are staggered in respect to each other along the lengths of corresponding portions 14, and span across staggered terminal receiving cavities 18 of a dielectric base 2 which is molded in place over the lead frame 8. Each base 2 is molded with integral projecting posts 20 defining therebetween wire receiving channels 22. Each channel 22 is aligned with a corresponding circuit portion 16. The posts 20 are formed with a series of blunt edged, wire gripping teeth 21 facing into the channels 22 from opposite sides thereof. The strip circuits 4 are substantially imbedded in the dielectric base 2. Yet, closely spaced, parallel portions 24 project outwardly from the end of an extended nose portion 26 of the base 2. Initially, the circuit portions 24 are interconnected by bridging portions 28 which maintain the portions 24 in parallel relationship during the molding operation. Subsequently, the bridging portions 28 are removed, for example, by a stamping operation which additionally severs the ends of the circuit portions 24 from the carrier strip 12, and severs the circuit portions 14 flush with a back wall 30 of the base 2. What results is a base wiring module as shown in FIGS. 4, 5, and 6. The projecting circuit portions 24 are then bent over to provide diagonally projecting resilient cantelever beams, gathered within and lying along a chamfered recess 32 in the base nose portion 26. The chamfered surface of the recess 32 provides an overstress stop to prevent excessive deflection of the cantelever beam portions toward the remainder of the base portion 2.

Figure 8:
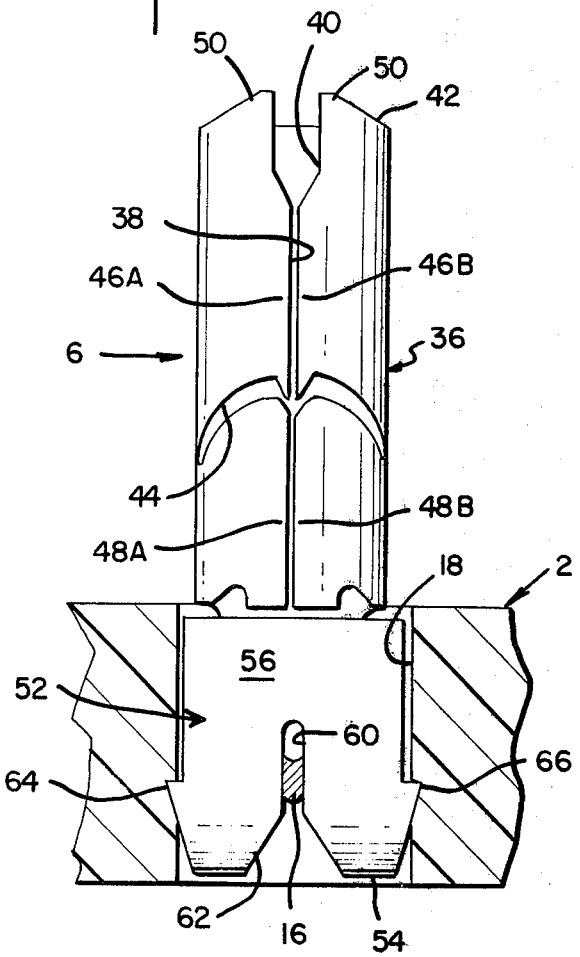
FIGS. 8 & 9 are enlarged fragmentary elevations with parts in section illustrating an electrical terminal and the assembly thereof to the base module.
Figure 9:
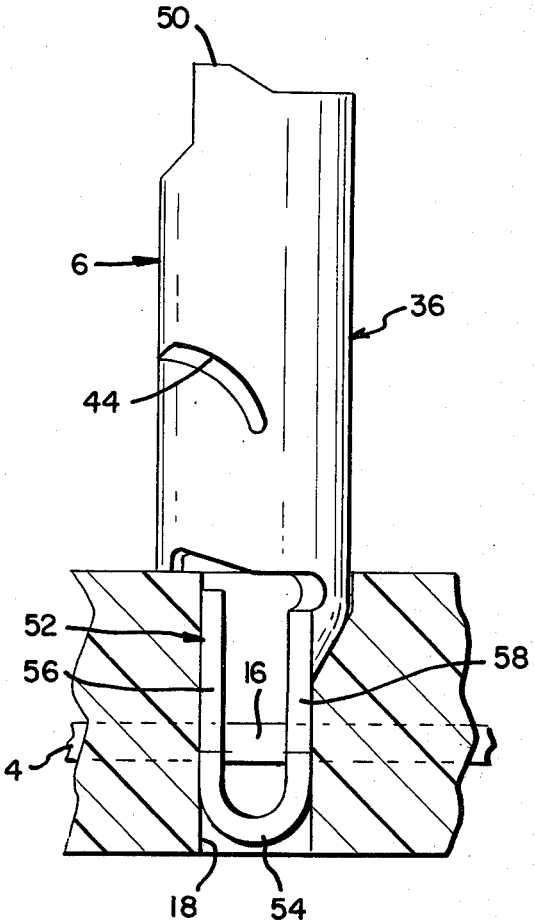

FIGS. 8 and 9 illustrate a free standing, stamped and formed metal terminal 6. Initially the terminal is stamped from a flat metal plate. A portion of the plate is formed into a cylindrical hollow barrel portion 36 with a longitudinal seam 38 defining a wire receiving slot into which one or more insulated wires are forcibly inserted laterally of their lengths. The seam 38 includes an enlarged flared entryway 40 which opens into a free end 42 of the barrel portion 36. The seam 38 is intersected by a transverse slot 44 which divides the barrel shaped portion into a first pair of resilient jaws 46A and 46B, and a second pair of resilient jaws 48A and 48B. The barrel portion 6 is of a diameter sized to fit within the inner diameter of a standard tool, such as a nut driver or binding post tool. In practice, a free end of an insulated wire, not shown, is laid inside the barrel portions 36 and along the entryway 40. A nut driver or binding post tool is aligned over the top end 42 of the terminal. A pair of tabs 50 projecting axially of the barrel outwardly on either side of the entryway 40 assists in aligning the terminal within the confines of the tool. The tool is then driven axially downward along the barrel portion 36 so that the tool pushes the wire within the entryway 40 axially of its length along the slot 38 until it is positioned between the jaws 46A and 46B. The jaws slice through any insulation on the wire and grippingly engage opposite sides of conductor portion of the wire exposed by slicing through the insulation. If desired, a second wire is electrically terminated to the terminal portion 36 in a similar fashion, using the binding post tool or nut driver to force the second wire along the slot 38. The inserted second wire pushes against the first inserted wire, forcing the same further along the slot 38A until the first inserted wire is positioned between the conductor gripping jaws 48A and 48B. The second wire will remain between the jaws 46A and 46B which will have sliced through the insulation to grippingly engage opposite sides of the conductor exposed by slicing through the insulation. The transverse slot allows the first set of jaws to flex independently of the second set, and vice versa.

The terminal 6 additionally includes a slotted plate portion 52 integral with the barrel portion 36 and formed with a U-shaped bight 54 interconnecting a pair of parellel plate portions 56 and 58. A slot 60 is formed through the bight 54 and partially along each of the plate portions 56 and 58. A flared entryway 62 is provided in the bight 54 communicating with the portions of the slot 60 within the plate portions 56 and 58. A pair of barbs 64 and 66 are provided on each plate portion 56 and 58. The terminal portion 52 is assembled within a terminal receiving cavity 18 with the barbs 64 and 66 penetrating into the side walls defining the cavity 18 so that the terminal is locked in position when the barrel portion end seats against the base 2. During insertion of the terminal portion 52 into the cavity 18 a corresponding circuit portion 16 is forcibly inserted along the slot entryway 62 and along the slot 60 and is compressibly engaged by opposite sides of the slot 60 in each of the plate portions 56 and 58. Thereby, each metal strip circuit 14 is electrically connected by its circuit portion 16 to a corresponding free standing terminal 6.

FIG. 3 illustrates a completed wiring module 1 in which insulated wires 53 are terminated electrically in the slots 38 of corresponding free standing terminal portions 6. Subsequent to connection in the terminals 6 in the manner described, each wire is inserted along a corresponding wire receiving channel 22 between the posts 20, with the teeth 21, which vertically extend the length of the posts, indenting into and gripping on opposite sides of the insulation to provide a mechanical anchor and strain relief. The module, once installed on the wires, is then ready to receive a cover assembled thereto for adapting the module to a desired use.

Figure 1:
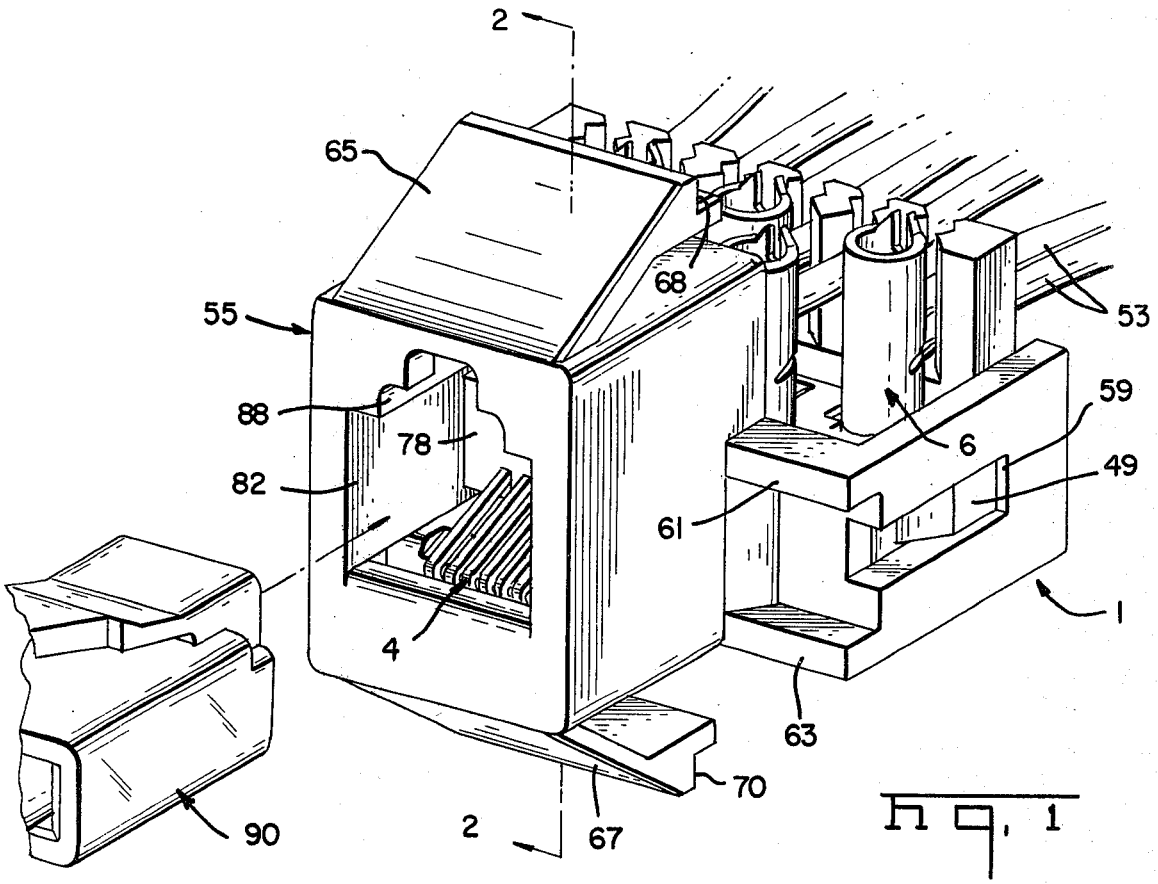
FIG. 1 is an enlarged fragmentary perspective of one preferred embodiment of a wiring module and a cover adapting the module to a panel mount.
Figure 2:
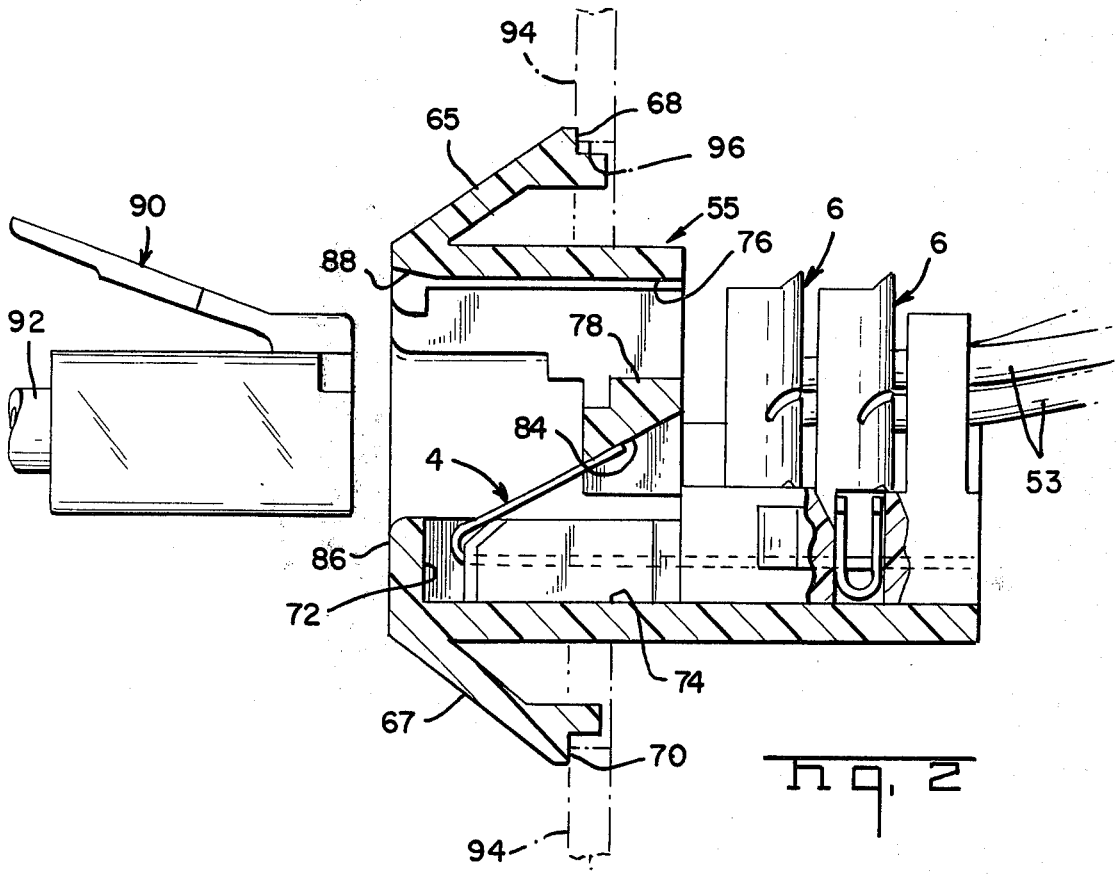
FIG. 2 is a section taken along the line 2—2 of FIG. 1.
Figure 1:
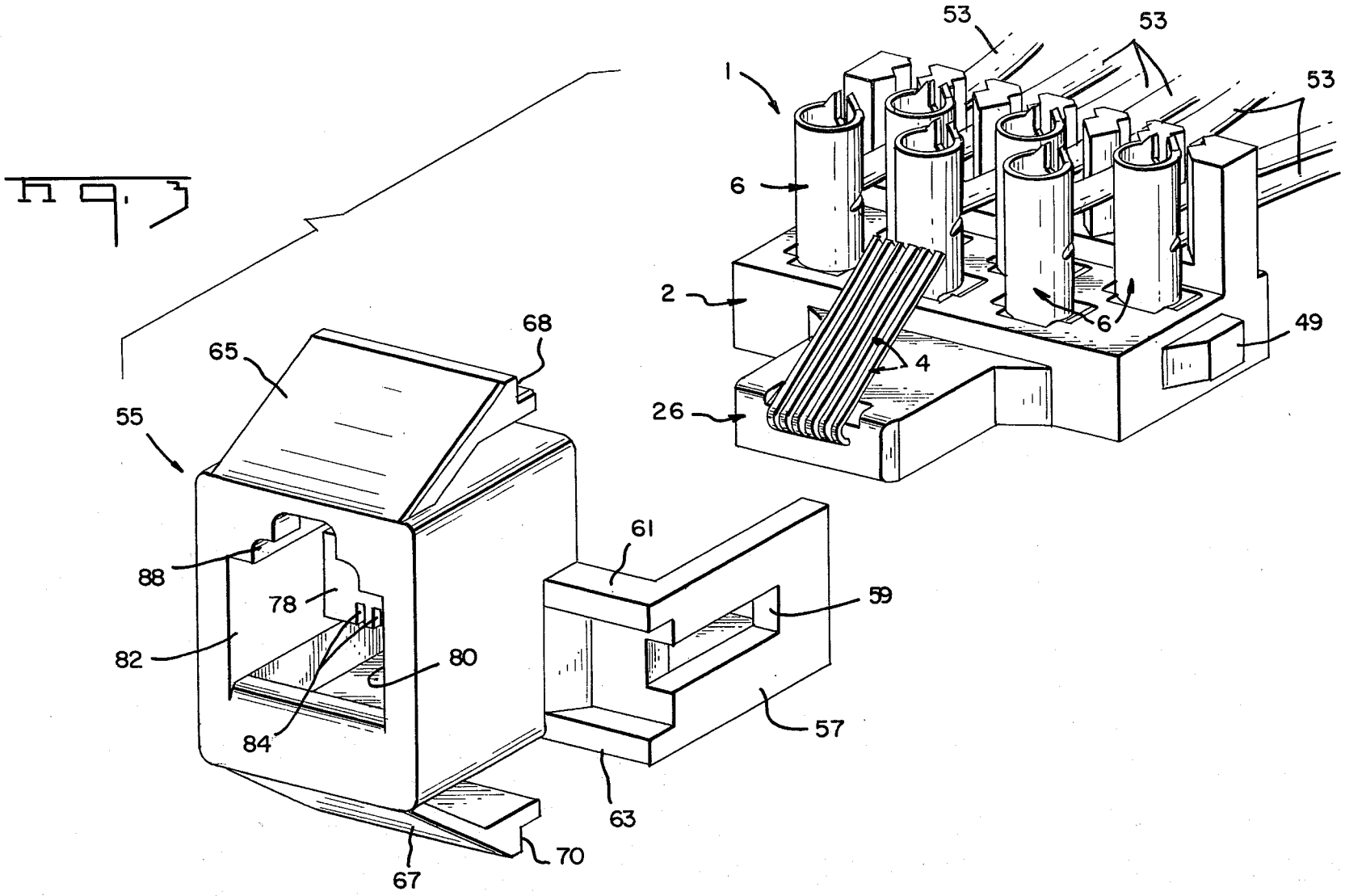

One embodiment of a cover is illustrated at 55 in FIGS. 1, 2, and 3. The cover is molded from a dielectric material and is provided with a pair of projecting latching arms 57 having a central slot 59 therethrough and panel bearing surfaces 61 and 63. A pair of diagonally inclined mounting flanges 65 and 67 include stepped, panel bearing surfaces 68 and 70 at the outer free ends thereof. The cover 55 includes an internal cavity 72 defined by a bottom wall 74 and the inverted surface of the top wall 76. An interior shelf 78 bridges between opposite side walls 80 and 82. A plurality of inverted parallel grooves 84 are provided in the shelf 78. FIG. 2 illustrates the grooves 84 as being deeply recessed and having diagonally inclined bottom walls. A front wall 86 of the cover 55 is provided with a profiled jack opening 88 communicating with the internal cavity 72. The profile of the jack opening 88 is compatable with that of a universal plug 90 of the type which is terminated to both ends of a telephone cable 92. The cover 55 is assembled over the nose portion 26 of the wiring module 1, with the latching arms 57 undergoing slight resilient deflection to slide over corresponding latches 49 and then snap against the sides of the base 2, when the latches 49 enter the slots 59 to lockingly retain the cover 55 and base 2 together. During assembly of the cover the cantilever circuit portions 4 enter into corresponding grooves 84, so that the shelf 78 separates the circuit portions 4 from one another, similar to a combing procedure, and positions them desirably in alignment with the profile opening 88. FIG. 2 shows in phantom outline, a panel 94 having an opening 96 therethrough into which the assembled cover 55 and wiring module 1 is to be mounted. The cover 55 is inserted through the panel opening 96, with the sides of the opening resiliently deflecting the diagonal arms 65 and 67, until they pass through the opening and spring outwardly away from the remainder of the housing, with the panel bearing surfaces 68 and 70 thereof seated against the front surface of the panel 94. Seated against the rear surface of the panel are the bearing surfaces 61 and 63 on the latching arms 57. The corresponding latching arms of the cover thereby mount the assembly in the panel opening 96 and lockingly retain the assembly in place. The panel 94 may be an instrument panel or a wall of a cabinet which houses communications equipment utilizing telephone communication networks for transmitting voice or data signals. The wires 53 connect the equipment to the wiring module 1, and the cover 55 receives the jack 90 therein which connects the conductors of the telephone cord 92 to corresponding circuit portions 4. The other end of the cord 92 is provided with a similar jack 90 for plugging into a telephone outlet jack.

Figure 10:
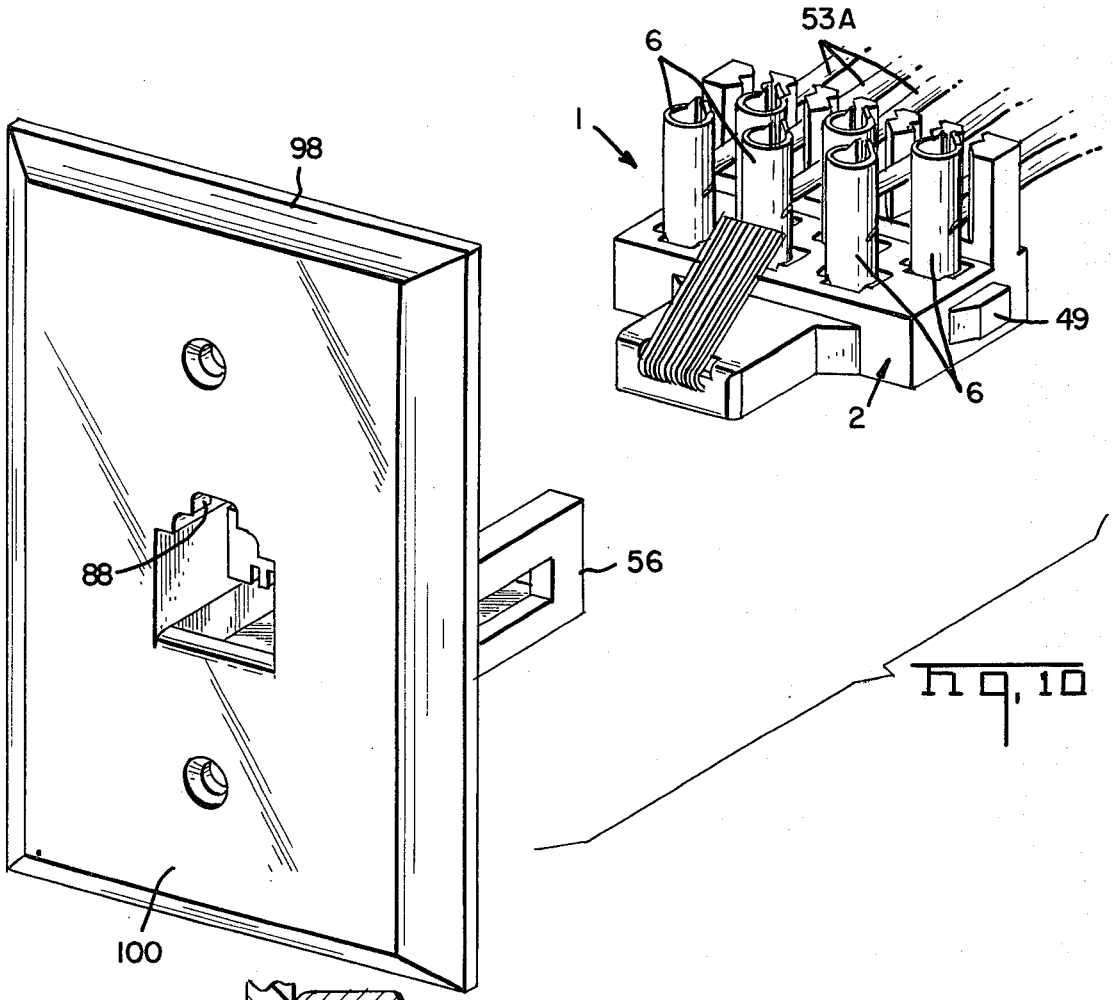
FIG. 10 is an enlarged perspective of a module terminated to telephone wires, together with a cover in exploded configuration which adapts the module for mounting in a wall opening.
Figure 11:
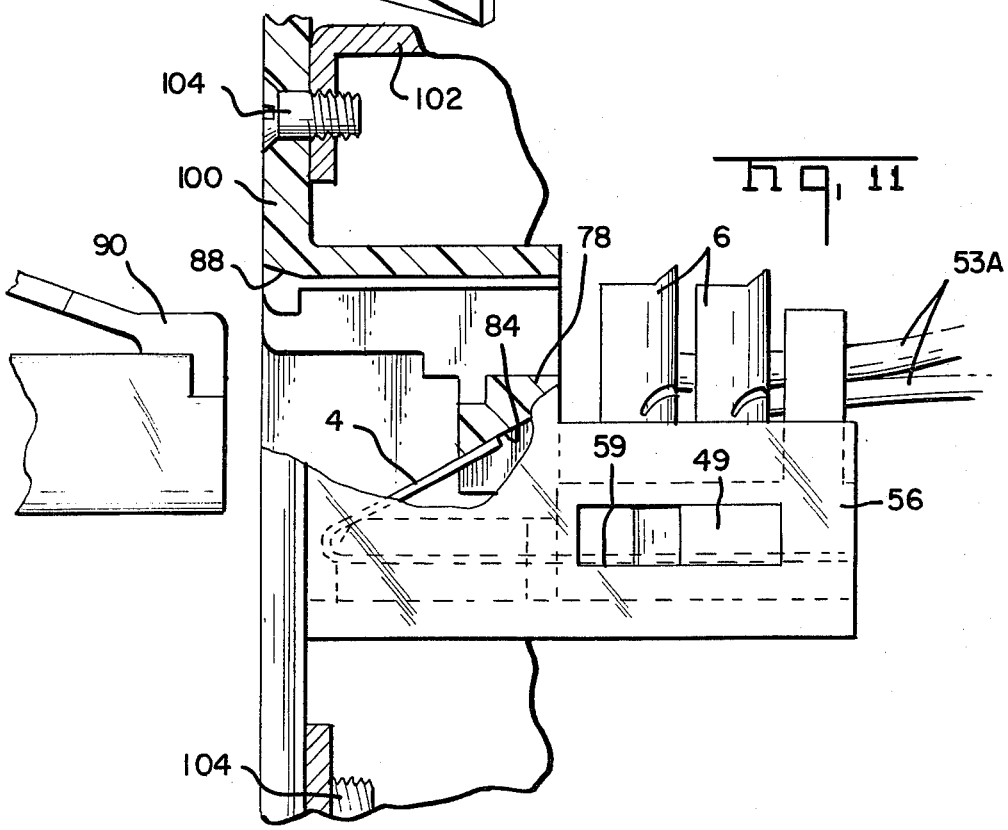
FIG. 11 is an enlarged elevation in section of the assembled cover and module of FIG. 10.

FIGS. 10 and 11 illustrate use of the wiring module and the telephone outlet jack. The wires 53A which are terminated to the terminals 6 are telephone wires which are routed from point to point within a building and project through wall openings in which telephone outlet jacks are to be provided. Since each terminal 6 has the capacity for terminating two wires, plural telephone wires may be spliced directly in the terminal so that plural telephone jacks may be coupled together with lengths of telephone wires. Once the wiring module 1 is installed on the telephone wires 53A, another type of cover 98 may be assembled to the wiring module 1. The cover 98 is similar to the cover 55, in that it is provided with the latching arm 56 which retain the latches 49 of the base 2 in the slots 59. The shelf 78 also is provided in the cover 98, with the grooves 84 in the shelf receiving the circuit portions 4 similarly as in the description of the cover 55. Cover 98 includes the profile opening 88 into which a jack 90 is pluggably received. Encircling the profile opening 88 is a face plate 100 molded integral with the remainder of the housing 98, and of the type for covering a wall opening. Once the cover 98 and wiring module 1 are assembled together, they are reinserted behind the wall opening, and within a metal receptacle box 102 which customarily lines the wall opening and protects the terminated portions of the wires 53A. Threaded fasteners 104 then secure the face plate 100 to the box 102 flush with the exposed surface of the wall. Since only small portions of the wires 53A are consumed in the wire terminations, adequate slack wire is reinserted into the box 102 and made available for subsequent repairs. Similarly, when telephone wires have been foreshortened by repeated repairs, termination of the foreshortened wires to the terminals of the wiring module 1 is readily accomplished with minimum wire consumption.

Figure 12:
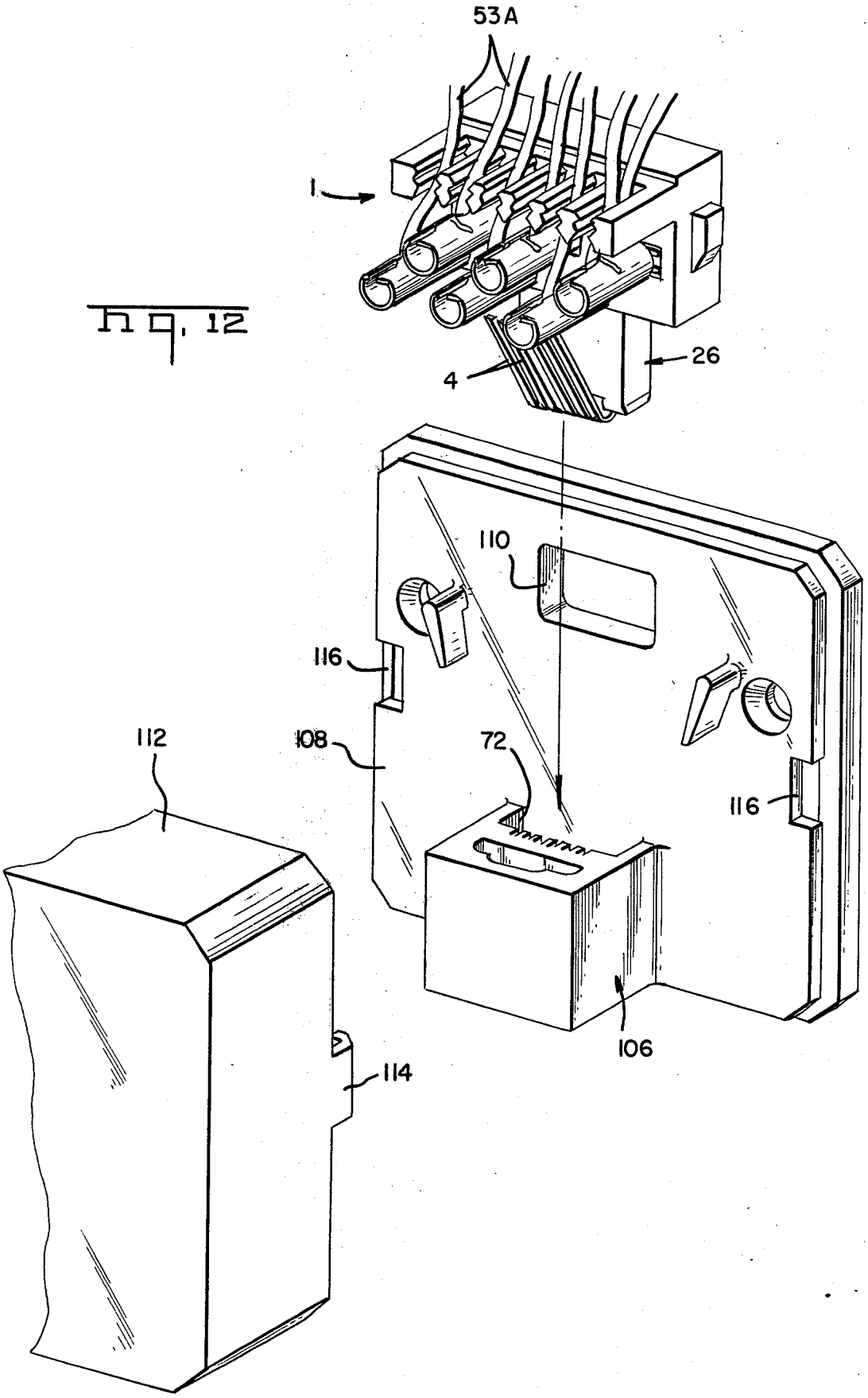
FIG. 12 is an enlarged fragmentary perspective with parts in exploded configuration illustrating a wiring module together with another type of cover for assembly with the module.

FIG. 12 illustrates another type of cover 106 projecting outwardly of a face plate 108. The terminated wires 53A project through an opening 110 in the face plate. Slack wire can remain in front of the face plate 108 after the same is secured over a wall opening. Alternatively, slack wiring may be reinserted through the opening 110 to lie behind the face plate. An auxiliary cover 112, provided with resilient latches, one of which is shown at 114, is assembled over the remainder of the wiring module 1 which protudes outwardly of the cover 106. The arms 114 resiliently snap and lock into latching recesses 116 provided in the face plate 108. The assembly provides a telephone outlet receptacle wherein the universal jack opening faces vertically downward.

Although preferred embodiments of the present invention are shown and described in detail, other embodiments and modifications thereof which would be apparent to one having ordinary skill in the art are intended to be covered by the spirit and scope of the claims.

What is claimed is:

1. An electrical connector adapted for splicing insulated wire, comprising:

an insulative base module having a plurality of terminal receiving cavities opening into a first side of said base module and carrying a plurality of metal circuits spanning said cavities, with resilient cantilever portions of said circuits projecting from a second side of said base module for resilient engagement with electrical contacts of a plug type electrical connector terminated electrically to multiple insulated wires of an electrical cable, means defining wire receiving channels along said first side of said base module, metal electrical terminals having first portions inserted in said cavities and secured electrically and directly to said circuits, with wire connecting portions projecting from said first side of said base module in alignment with respective said wire receiving channels and constructed for splicing pairs of insulated wires inserted along and grippingly retained in respective said channels, and a one piece cover for assembly on said second side of said base module and having an internal profiled jack cavity enclosing said cantilever portions and adapted for pluggable receipt of said plug type electrical connector therein.

2. The structure as recited in claim 1, wherein, said cover includes an integral face plate adapted for mounting against a wall covering an opening through which said wires project, and means cooperating with said face plate for covering said base module and said terminals as well as portions of said wires connected to said terminals.

3. The structure as recited in claim 1, wherein, said cover includes latching means securing said base module thereto, and panel mounting means for suspending the assembly of said cover and said base module in an opening through the thickness of a panel.

4. A wire splicing electrical jack adapted for wall mounting, comprising:

an insulative base module, a plurality of electrical circuits extending within the thickness of said base module and having respective cantilever portions projecting from one side of said base module, a plurality of electrical terminals projecting into the thickness of said base module and connected electrically to respective said circuits, said terminals including wire terminating portions, each projecting from another side of said base module and each having resilient, insulation penetrating and wire engaging jaws for electrical connection with and splicing together of a pair of insulation covered wires, an insulative, one piece cover having a profiled, plug receiving opening mounted over said cantilever portions, first means on said cover for securing the same over a wall opening, second means connecting said base module to said cover with said wire terminating portions projecting outwardly of said cover and suspended therefrom.

5. A wire splicing electrical jack, adapted for wall mounting, comprising:

an insulative base module, a plurality of metal electrical circuits having resilient cantilever contact portions projecting from one side of said base module and received in a profiled plug receiving opening provided in an insulative, one-piece cover adapted for mounting in a panel wall with said circuits extending outwardly away from said cover and said plug receiving opening and along said base module and directly connected to respective electrical terminals remote from said cover and having respective insulation penetrating and wire engaging jaws projecting from a second side of said base module for electrical connection with a pair of insulation covered wires, and means for securing said cover on said base module without covering said terminals.

6. The structure as recited in each of claims 1, 4 or 5, and further comprising:

an auxiliary cover secured to said first recited cover and assembled over that portion of the base module which projects outwardly of said first recited cover.

7. The structure as recited in each of claims 4 or 5, and further including: means projecting from said base module for grippingly retaining pairs of wires connected electrically to respective said terminals.

8. The structure as recited in end of claims 4 or 5 and further including: channels integrally provided on a portion of said base module which projects outwardly of said cover, said channels grippingly retaining pairs of wires connected electrically to respective said terminals.

9. The structure as recited in each of claims 4 or 5, wherein, said base module is provided with a plurality of cavities, said circuits span across respective said cavities, and each of said terminals is stamped and formed from a metal blank and is received in a respective said cavity and is engaged directly with a respective said circuit.

* * * * *

UNITED STATES PATENT AND TRADEMARK OFFICE

Certificate

Patent No. 4,261,633 Patented April 14, 1981

Lynn Wilson Abernethy

Application having been made by Lynn Wilson Abernethy, the inventor named in the patent above-identified, and AMP, Inc., the assignee, for the issuance of a certificate under the provisions of Title 35, Section 256, of the United States Code, adding the name of Sandra G. Tuttle as a joint inventor, and a showing and proof of facts satisfying the requirements of the said section having been submitted, it is this 14th day of February, 1984, certified that the name of the said Sandra G. Tuttle is hereby added to the said patent as a joint inventor with the said Lynn Wilson Abernethy.

Fred W. Sherling,
*Associate Solicitor.*